United States Patent [19]

Nitschmann

[11] Patent Number: 4,718,315

[45] Date of Patent: Jan. 12, 1988

[54] RATCHET-TYPE WRENCH

[76] Inventor: Fred-Werner Nitschmann, Arabellastrasse 5, 8000 Munich 81, Fed. Rep. of Germany

[21] Appl. No.: 820,588

[22] PCT Filed: Jul. 7, 1983

[86] PCT No.: PCT/EP83/00177

§ 371 Date: Mar. 6, 1984

§ 102(e) Date: Mar. 6, 1984

[87] PCT Pub. No.: WO84/00316

PCT Pub. Date: Feb. 2, 1984

Related U.S. Application Data

[63] Continuation of Ser. No. 596,470, Mar. 6, 1984, abandoned.

[30] Foreign Application Priority Data

Jul. 9, 1982 [DE] Fed. Rep. of Germany ..... 3225815
Apr. 12, 1983 [DE] Fed. Rep. of Germany ..... 3315151

[51] Int. Cl.[4] ..... B25B 13/46

[52] U.S. Cl. ..... 81/58.2; 81/117; 81/176.3

[58] Field of Search ..... 81/58, 58.2, 58.3, 111, 81/126, 117, 128, 176.3

[56] References Cited

U.S. PATENT DOCUMENTS 1,183,371 5/1916 Ginsburg ..... 81/111
2,618,996 11/1952 Logan ..... 81/111
2,643,568 6/1953 Milentz ..... 81/111

FOREIGN PATENT DOCUMENTS 1403411 12/1958 Fed. Rep. of Germany ..... 81/111
1810811 6/1970 Fed. Rep. of Germany ..... 81/58

*Primary Examiner*—Robert P. Olszewski
*Assistant Examiner*—Bradley I. Vaught
*Attorney, Agent, or Firm*—Sughrue, Mion, Zinn, Macpeak, and Seas

[57] ABSTRACT

A ratchet-like wrench is provided with a wrench body having a fixed jaw and a two arm jaw pivotally mounted on the wrench body to define a spanner aperture with the fixed jaw. A two armed wrench handle is pivotally connected to the wrench body with one arm of the handle operatively engaging one arm of the pivotable jaw. A rocker element and a coupling element are pivotally connected to each other and to the fixed jaw and the pivotable jaw respectively to form a toggle-link linkage for moving the pivoted jaw into and out of operative position. A return spring is disposed between the coupling element and the pivotal jaw for biasing the pivoted jaw to the open condition and for preloading the coupling element and the rocker element toward a locking position. The coupling element is provided with a projection operatively engaged by the handle so that upon pivotal movement of the handle the rocker element and the coupling element can be moved into and out of alignment. The jaws may be provided with detachable spanner aperture inserts for accommodating different size nuts.

5 Claims, 7 Drawing Figures

FIG.5
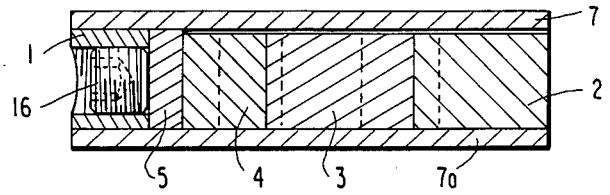
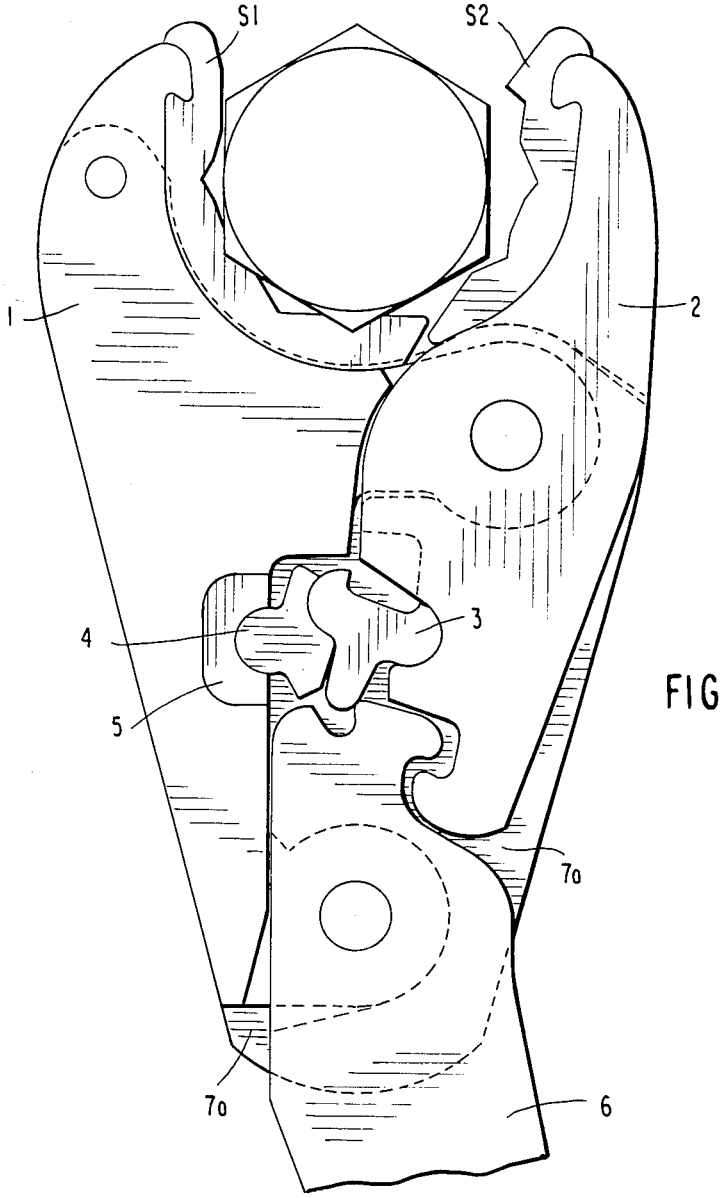
FIG.6

RATCHET-TYPE WRENCH

This is a continuation of application Ser. No. 596,470, filed Mar. 6, 1984, now abandoned.

BACKGROUND OF THE INVENTION

The invention relates to an automatically opening and closing combined open-ended spanner and rapid screwing tool having a ratchet action, which is equipped with an integrated locking element and adjusting system. The ratchet-like wrench, or automatic wrench has an auxiliary assembling device and interchangeable, spanner-width inserts for each particular wrench size. As a result, it is extremely versatile and particularly easy and convenient to handle upon tightening and freeing fastening elements, preferably hexagonal-head bolts and hexagonal nuts, without withdrawal, repositioning or removal of the wrench during a gripping or screwing action and once it has been fitted.

DE-PS 449510 discloses a wrench of the kind described above, in which the return spring located in the fixed jaw acts directly on the aperture-side lever arm of the wrench handle, so that the same actuates the movable jaw in such manner that it operates similarly to pincers on the bolt or nut element which is to be freed or tightened. This pincer-like action of the movable jaw has the disadvantage that the fastening element, in the form of the nut or bolt head, which is to be freed or tightened is exposed to a comparatively high degree of wear during the ratchet-like take-up displacement of the tool, so that the edges of the fastening elements may be damaged, after repeated application of the wrench, to such a degree that the application of a standard ring spanner is no longer possible. On the other hand, the operating surfaces of the wrench also undergo a comparatively high degree of stress, thereby adversely affecting their durability. Another disadvantage of this known wrench is to be seen in that the return spring acts on the pivotable jaw with a very large leverage in the ratchet position of the wrench, so that the ratchet action may, as a rule, be brought to bear effectively only if the handle is made to follow on positively and at comparatively high speed. Furthermore, this known ratchet-like wrench is constructed with a comparatively massive spanner head and is thus comparatively unwieldy so that it has not hitherto gained acceptance in this form of construction.

SUMMARY OF THE INVENTION

The invention has the fundamental problem of devising a ratchet-like wrench which, with lesser strain on the mutually engaged surfaces of the coupling means and the wrench jaws, may be actuated in a very uncomplicated manner and operates particularly smoothly but which nevertheless operates in force-locked manner, is very stable and may consequently reliably transmit large forces.

Any pincer action by the two wrench jaws is prevented by the features according to the invention. On the contrary, the two jaws have an operating position which is predetermined in a geometrically precise manner and in which the movable jaw is supported on the stationary jaw in a manner defined by the coupling member and the rocker, so that the hexagonal bolt head or nut which is to be freed or tightened is embraced in a wholly slip-proof manner at this instant. On the other hand, the movable jaw assumes a second unlocked state in the ratchet position of the wrench, which is again precisely defined as regards positioning and, in which the contact force between the movable jaw or aperture and the fastening means is practically nil, so that the surfaces in mutual engagement are treated in the least harmful manner. The measures according to the invention provide the particularly advantageous possibility of optimising the engagement between the pivotable jaw, the coupling element and the rocker, in such manner that a sufficiently large pivotal action is produced for the movable jaw by a very small angle of pivotal displacement of the wrench handle, thereby to cause the tool to follow on in ratchet-like manner with the application of very little force. In this way the lever deflection of the handle may successfully be kept below 15° upon appropriate optimisation of the form of the rocker, coupling element and handle-side lever arm of the movable jaw, so that hitherto inaccessible assembly areas may easily be reached with a wrench according to the invention. The stability of the wrench is not impaired, because the coupling element and the rocker are stressed exclusively under compression in the operating position, i.e. in the locked position of the wrench, so that even the largest tightening torques may be transmitted reliably by the wrench. The form of the wrench according to the invention, furthermore, has the additional advantage that the return spring may have smaller dimensions, which for its part has an advantageous effect on the overall dimensions of the wrench, on the one hand, and on its ease of handling, on the other hand, since the spanner handle henceforth needs merely to be pivoted with only a very small force to move the coupling element out of the locked position sufficiently so that the movable jaw is released.

The return spring could, however, also act on the rocker. The arrangement with the spring bearing against the coupling element is particularly advantageous, however, since in this development, this spring force is co-opted in the unlocked position to keep the contacting surfaces between the coupling element and the movable jaw reliably in engagement and, on the other hand, to displace the movable jaw resiliently in the freeing direction.

If the coupling element forms part of a four-link transmission, the kinematic optimisation measures quoted before may be implemented in a very uncomplicated manner, thereby establishing the particularly advantageous possibility of constructing the link connections very compactly, particularly, if the link surfaces are formed by unilaterally open sliding surfaces. The additional advantage results, moreover, from this development, that all the parts of the four-link transmission may be produced very economically by cutting lengths from appropriately rolled steel sections.

The use of detachable spanner aperture inserts leads to other complementary advantages, that is to say, in the case of different spanner base sizes, up to five different sizes of hexagonal-head bolts or hexagonal nuts may be freed or tightened for each size without reaching the stress limits of the wrench whilst doing so. The graduation of the spanner aperture inserts allows the spanner aperture insert allocated to the movable jaw to be entrained with this jaw in the unlocked position, i.e. in the ratchet position of the wrench, so that the spanner aperture insert may reliably slide past the outer surface of the securing means and without the application of force. The use of a screw type adjustable element leads to the particularly advantageous possibility of adjusting the spanner aperture of the wrench by means of the adjusting element, to an optimum degree.

The components of the four-link transmission which is acted upon by the return spring may to this end be so formed, in an uncomplicated manner, that a clearly discernible ratchet action occurs under automatic aperture opening by actuation of the handle, whilst following up with the tool, simultaneously ensuring that the interchangeable spanner aperture inserts engage in optimum and protective manner in the engaged position required for the next tightening displacement of the fastening device.

The loading capacity of the wrench is increased complementarily by the cup-like engagement of the coupling and rocking links.

A special advantage of the invention also consists in the fact that the coupling element is positively guided during operation of the wrench handle to establish the ratchet position of the movable jaw, so that a precisely defined and co-ordinated angular position of the movable jaw is allocated to each angular position of the wrench handle.

The operational precision of the wrench is also increased complementarily by the fact that the coupling element has a recess in the upper edge for reception of a compression spring. The recess may clearly also be replaced by a countersunk or differently shaped surface form of the coupling element without thereby impairing the functional reliability of the wrench.

A preferred embodiment of the wrench shown in FIG. 3 provides a wrench with very great rigidity and a comparatively small structural volume.

The integral base plate or the bottom jacket plate, furthermore leads to another advantageous solution with respect to the mounting of the spanner aperture inserts. For example, if the smaller semicircular section is allocated to the bottom jacket plate, this forms an edge projection which may be co-opted as a supporting bearer for reception of the spanner aperture inserts.

The development of the spanner aperture inserts, in particular, provides the especially advantageous action that the hexagonal nut or bolt head which is to be freed or tightened is grasped almost as though by a ring spanner, in the locked position of the wrench, and is released to such a degree, even during a pivotal displacement of the movable jaw of between 3° and 6°, that the aperture may easily slide over the edges of the fastening device. A rocking angle of the movable jaw of this amount is barely discernible to the eye, but it has been found that this pivot angle is wholly adequate to release the bolt.

If the aperture-side lever arm of the wrench handle is formed in accordance with FIG. 3, a wholly reliable guiding action is the result for the coupling element throughout the range of pivotal displacement, so that faulty operations of the wrench may be avoided.

According to FIG. 1, the possibility moreover offers itself that the wrench may be equipped with an interchangeable handle lever, a precisely fitting freeing element being integrated in the aperture-side lever arm of the wrench handle which is in direct functional engagement with the same; it may, however, also be a fixed part of the lever, as illustrated in FIGS. 2 and 3.

A wrench of a universal type is consequently obtained by virtue of the replaceability of the complete screwing tool head, which fulfils individual as well as ergonomic requirements in view of the separability of the lever.

The bearing edge on the movable jaw element provides for better engagement of the connecting element and thus for an increase in the transmissible forces.

By appropriately positioning the parting line of the spanner aperture inserts the loading capacity of these inserts can be kept at a very high level, the spanner aperture inserts simultaneously retaining an optimum degree of mobility, which is necessary for following the displacement of the movable jaw.

A feature of the invention is seen to consist in the position of the parting line of the spanner aperture inserts S1 and S2, which extends at an angle of say 30° to the axis of symmetry of the wrench, in such a manner that the two spanner aperture inserts S1 and S2 are braced against each other in a wedged manner in the operating position, and are forced against the internal periphery of the aperture under the action of these bracing forces. This provides the wrench with a particularly great stability. Other particularly advantageous embodiments form the objects of the other subordinate claims. Several examples of embodiment of the invention are particularly described hereafter with reference to diagrammatical drawings.

BRIEF DESCRIPTION OF THE DRAWINGS

FIG. 5 is a sectional view taken along the line X—X in FIG. 4.

FIG. 6 is a partial plane view of the embodiment of FIG. 3 with jaws in the open condition.

DETAILED DESCRIPTION OF THE INVENTION

Figure 1:
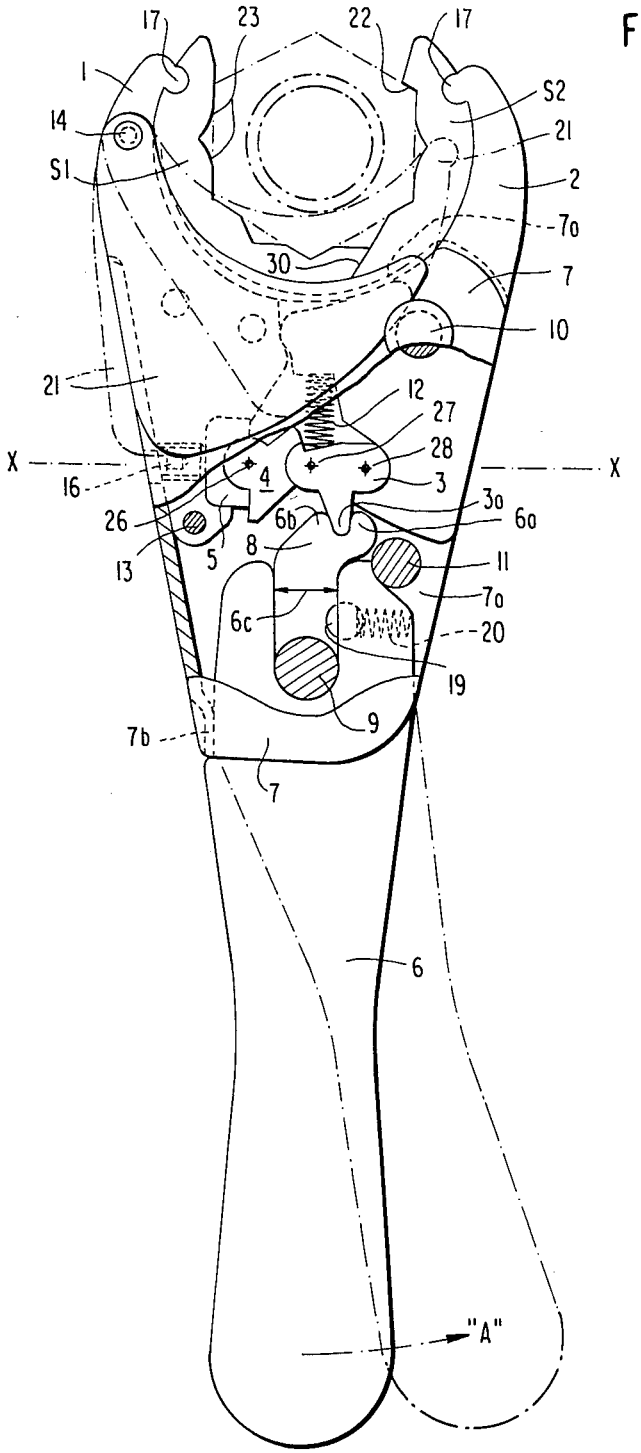
FIG. 1 shows a partly cut-away plan view of a first form of embodiment of the ratchet-like wrench constructed as an universal tool offering multiple interchangeability, the spanner handle being capable of being inserted or withdrawn in the longitudinal direction of the tool, and in which the spanner aperture inserts are interchangeable and the tool is moreover provided with an aperture width adjusting mechanism.

Reference is made in the following to FIG. 1, showing a first form of embodiment of an automatic or ratchet-like wrench. The tool comprises a wrench body provided with a fixed jaw 1 in which a two-armed pivotable jaw 2 is mounted by means of a bolt 10. One arm of moveable jaw 2 engages the insert S2 while the other arm of the moveable jaw 2 engages a coupling element 3. The wrench body 1 also has mounted in it, by means of a bolt 9, a two-armed wrench lever handle which co-operates with the pivotable jaw 2, through coupling element 3 and a releasing element 8 which engages in an aperture in one arm of the lever handle. The other arm of the two arm wrench lever handle constitutes the handle grip portion. The wrench handle is in engagement, via a ball detent device 19 and 20, with the releasing element 8 which is supported on the bolt 9 in such manner that it may pivot freely. The pivotal displacement is initiated by the bifurcated extremity of the wrench handle which for its part is supported on a stabilising bolt 11 whereby the locking position of the wrench is determined. The wrench handle may be removed from the wrench body in any optional position by overcoming the engagement lock 19,20. The locking position of the wrench, in which the movable jaw 2 assumes a locked position, is illustrated by the solid lines. The jaw 2 is a component of a four-link transmission and forms its crank. It is in jointed engagement with a coupling element 3 which is engaged, on the one hand, via a pivot joint having a center 27, with a rocker 4 and, on the other hand, with the bifurcated releasing element 8 apertured lever arm of the wrench handle 6 via an actuating or control pin 3*a*. In the locking position, the four-link transmission is thus situated in an extended position so that pivot centres 26,27 and 28 of the rocker and coupling element lie on an action line or straight action line x—x. The aperture of the wrench receives interchangeable spanner aperture inserts S1 and S2, which are split along a parting line 30, so that the spanner aperture insert S2, allocated to the movable jaw 2, may follow the displacement of the jaw.

A stop bolt 11 is complementarily provided in the wrench body, on which the apertured lever arm of the wrench handle is supported in the locking position of the wrench. This bolt 11 sets the extended position of the four-link transmission by engaging the cam extension 3*a* of the coupling element 3, an appropriate prestressing spring 12, preferably, a compression spring, being provided to establish this extended position and engaging in a recess of the coupling element. This spring 12 is supported on the movable jaw 2, on the side facing away from the coupling element 3. The connecting surfaces between the coupling element and the rocker or between the coupling element and the movable jaw, are formed in a cup-like manner, these surfaces commonly being formed by part cylindrical jacket surfaces. This embodiment renders it possible to produce the coupling elements and the rockers as rolled section elements. The rocker bears, via a pivot joint having a center 26 on an adjusting element 5 which is locked in an adjustable manner in the wrench body 1 by means of a set screw 16. The operation of the wrench illustrated in FIG. 1 is as follows When the spanner handle is moved clockwise according to FIG. 1, the same is supported on the one hand on the bolt 9 and on the other on the mating bolt 11, so that the extended position of the four-link transmission is retained, and that the nut denoted by the dash-dotted line in FIG. 1 is displaced reliably. To restrict the spanner handle complementarily, the spanner body which for example is formed by a sheathing plate 7 bent to U-shape, may be provided with an impingement surface 7*b* on which is supported the left-hand side surface of the spanner handle. When the wrench is to be made to follow on, the spanner handle is pivoted in the direction of the arrow "A" shown in FIG. 1, for example, through a maximum of 15°, so that the apertured lever arm of the spanner handle is moved out of contact with the bolt 11. At the same time, this lever arm of the spanner handle displaces the cam-like extension 3*a* of the coupling element according to FIG. 1 towards the left by means of the projection 6*a*, so that the four-link transmission is pivoted out of the extended position whilst overcoming the preloading force of the spring 12 and that the movable jaw 2 is pivoted clockwise under the action of the preloading spring 12 through 3° to 6°, for example, this angle depending on the spanner aperture insert momentarily present in the aperture. This pivoting angle is sufficient to cancel the shape-locked engagement between the spanner aperture inserts S1 and S2 and the fastening device, so that the wrench tool may be made to follow on to an optional extent, without application of force. An audible ratchet action occurs upon doing so, which reliably assures that the recesses of the spanner aperture inserts S1 and S2 reliably embrace the edges of the fastening device, for example, of the hexagonal nut. The spanner handle is displaced clockwise again once the follow-on displacement is completed, the positive guidance edge 6*b* of the spanner handle 6 ensuring in this case that the coupling element is returned to the extended position illustrated in FIG. 1. The fastening device may then be operated again.

It is thus apparent that a locking element system which is to be described as a locking joint 3,4, is unlocked upon actuation of the spanner handle 6 in the direction "A" around the bolt 9 as a centre of rotation. This unlocking operation is initiated by the unlocking projection 6*a* of the apertured lever arm of the spanner handle 6, whilst acting on the release pin 3*a* of the coupling element, which causes the coupling element 3 to describe an upwardly directed pivotal displacement which is simultaneously positively guided in the coupling element 3 by means of the spring element 12 preferably being a compression spring, by virtue of a recess, and initiates a tilting displacement opening the aperture of the movable jaw around the pivot pin centre 10. The rocker 4 at the same time mandatorily follows the upwardly directed pivotal displacement of the coupling element 3 around the centre of rotation of the semi-circular recess 26 of the take-up element 5.

The commonly hardened spanner aperture inserts S1 and S2 cause a clearly audible clicking which should be described as a ratchet action during the take-up displacement of the tool in any possible position of engagement with the fastening device, and thereby simultaneously precisely indicate the ideal engagement position reached for the next tightening displacement, said device for example being a fastening nut. Furthermore, the resetting force of the spring 12 takes over the final locking of the locking joint 3,4 comprising a coupling element and rocker, thereby eliminating any application of force.

The aperture formed by the spanner body and the movable jaw 2 comprises fitting elements 17 in optional arrangement and formed in prism-like manner for preference, which serve the purpose of receiving and entraining the spanner aperture inserts S1 and S2. The spanner aperture inserts S1 and S2 are moreover formed by segment-like engagement elements which are provided with 24 or preferably 12 edges corresponding to the full circle. The spanner aperture insert S1 allocated to the fixed jaw 1 has a curvature or an edge bevel 23 which is made less than 15° for example as a lead in for the aperture opening, preferentially for a 12 edge form, which is a presupposition for trouble-free tool take-up displacement during the screwing action. The spanner aperture insert S2 allocated to the other jaw 2 has a narrow bearing edge 22 at the front extremity of the aperture opening, which engages over an edge of the hexagonal nut.

It is apparent from the preceding description that several parts of the screwing tool are replaceable and that an adjusting device 16 and 5 which may be integrated in comparatively easy manner is provided for the displacement of the spanner aperture inserts S1,S2 or of the movable jaw 2. This adjusting device, in the form of the take-up element 5, which may be taken up under delimitation by the setting screw 16, has the special advantage that the movable jaw 2 may be reset at any time and may at the same time be adapted to fit against the connecting elements in question with optional tightness, possibly even with allowance for the degree of wear. To this end, the resetting element 5 is housed in the fixed jaw member 1.

The most important replaceable parts of the wrench are the spanner aperture inserts S1 and S2, as well as the wrench handle 6, which may at the same time be replaceable at each side. As stated in the foregoing, the spanner aperture inserts S1 and S2 are received, located and immobilised by so-called fitting elements 17 which are fixed components of the jaw element 1 rigidly coupled to the sheathing plate 7, or of the movable jaw 2. The underside of the jacket plate 7 at the same time acts as a support from below for the spanner aperture inserts S1,S2, one branch of the jacket plate 7 being provided in this case with a slightly smaller recess than the top side of the sheathing plate which is illustrated in plan view in FIG. 1. An assisting device in the form of a hinged plate 21 which may be pivoted around the pivot joint 14, and which simplifies assembling, is provided at this side of the sheathing plate. The pivotability then operates as shown by the dash-dotted line, so far that the hinged plate covers a part of the fastening device, being the nut in this case. The hinged plate 21 thus not only secures the spanner aperture inserts S1 and S2 against dropping out, but may complementarily act to guide the tool on an assembling element, for example a screw-threaded rod, upon which is positioned the nut which is to be tightened. For complementary stabilisation of the hinged plate 21, this is guided in a groove of the bolt 10 and at the same time acts to limit its angle of pivotal displacement. The spanner aperture inserts S1,S2 are installed in a particularly easy fit and may thus be replaced extremely easily. The second figure shows an embodiment which differs in essence from the form of embodiment shown in FIG. 1, in that none of the components are exchangeable and adjustable. This example of embodiment represents a wrench of so-called rigid or compact structure.

Figure 3:
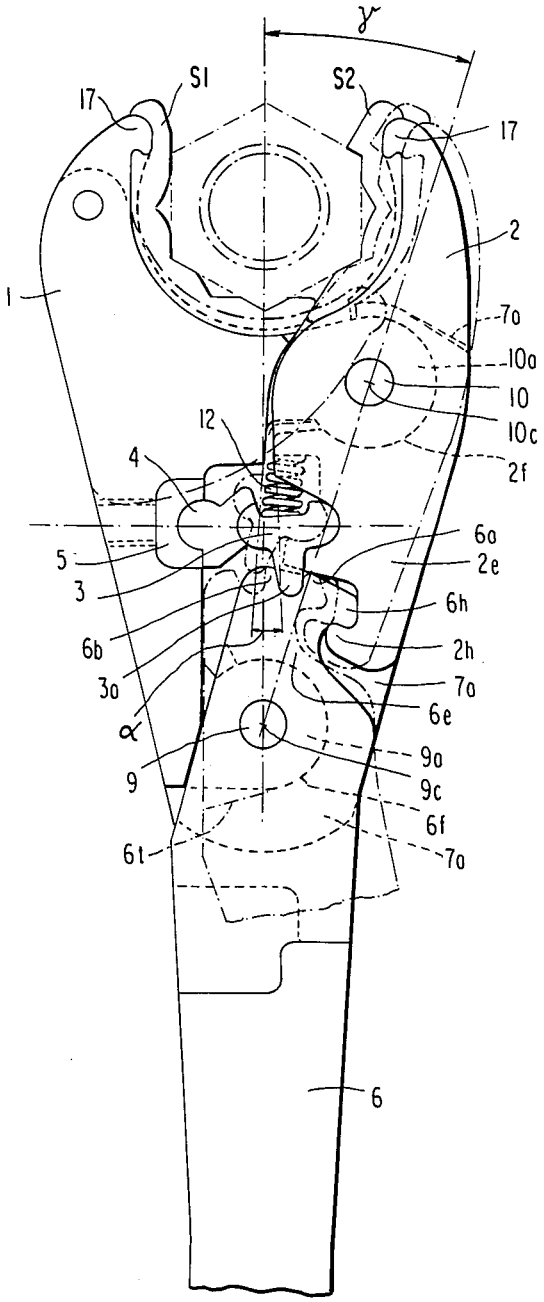
FIG. 3 shows a view similar to FIGS. 1 and 2 of another form of embodiment of the automatic wrench with the cover plate removed, having joint bores formed in the wrench body and an overload locking device formed by interengagement of the lever and the movable jaw.
Figure 4:
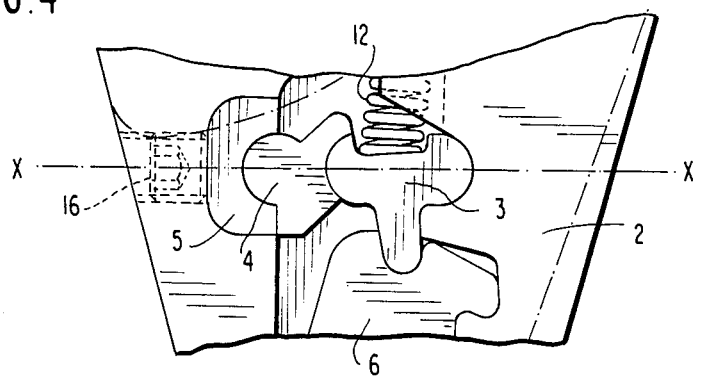
FIG. 4 is a partial plan view of the wrench of FIG. 3 showing the pivot points for the rocker member and coupling member in aligned condition during closing of the jaws.
Figure 7:
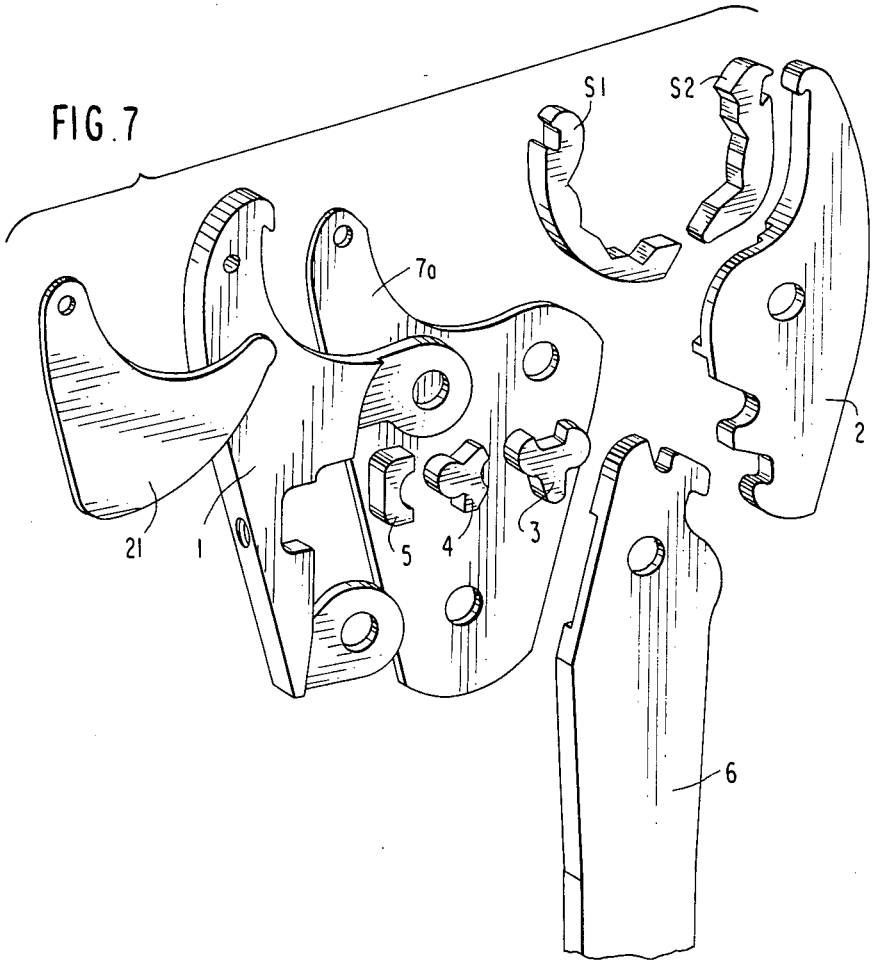
FIG. 7 is an exploded view of the wrench according to the embodiment of FIG. 3.

Another form of embodiment of the automatic wrench is shown in FIG. 3. The structure of this embodiment corresponds in optimum degree to that of the embodiments described in the foregoing. To simplify matters, reference symbols are entered in the drawing only for the most essential parts, or for the parts which differ in their production technology from the components described earlier. The essential differences from the forms of embodiment described in the foregoing consist in the different kind of mounting of the movable jaw element 2 and of the lever 6 in the wrench body, of the arrangement of the prism-like fitting elements 17, as well as in a modified functional engagement between the lever 6 and the movable jaw element 2.

Figure 2:
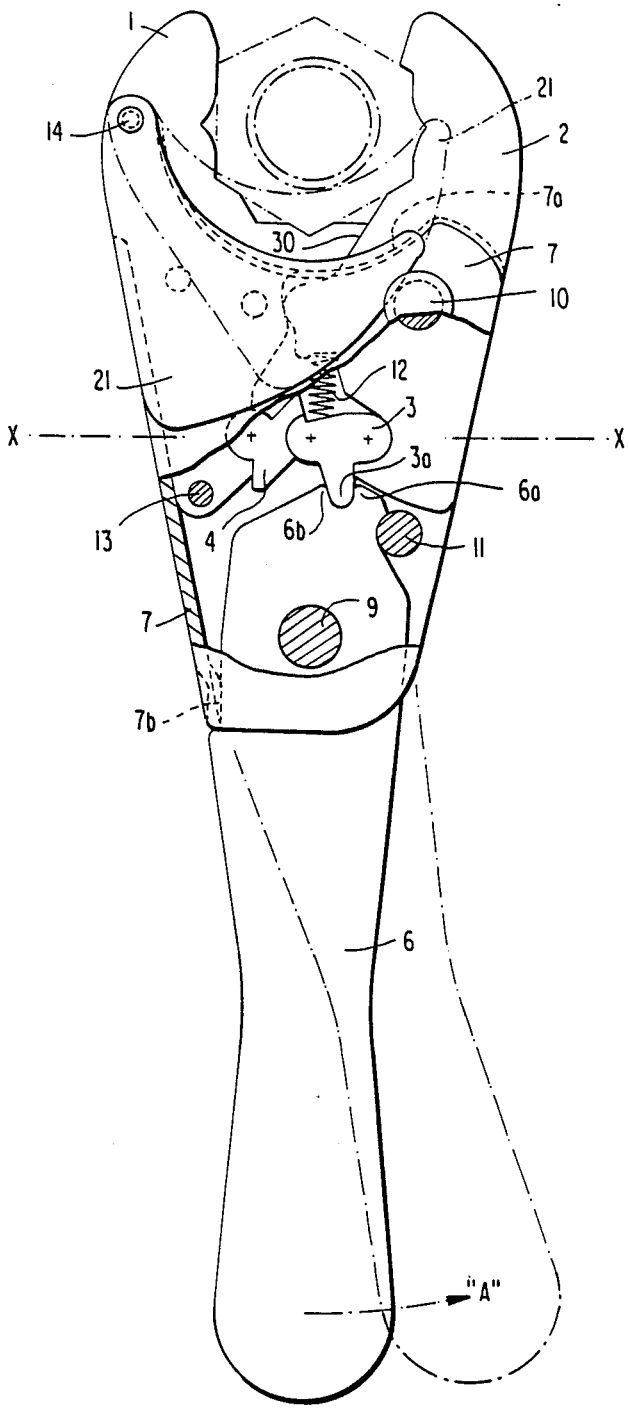
FIG. 2 shows a view similar to FIG. 1 of a second example of embodiment, but without any provisions for adjustment and substitution of the spanner aperture inserts and the spanner handle.

In the case of the automatic wrench illustrated in FIG. 3, the movable jaw element 2 is installed directly on the fixed jaw element 1 in the articulated manner. The lockable locking element system which is also preloaded by a spring 12 is constructed in the same way as in the embodiments described in the foregoing. By contrast to the form of the fixed jaw element 1 of the embodiments according to FIGS. 1 and 2, the jaw element 1 shown as a FIG. 3 has formed in unit with the base plate **7*a* on the one hand and on the other hand a joint bearing boss 10*a* which has a height substantially corresponding to half the thickness of the automatic wrench. A substantially greater stability is thereby conferred on the jaw element 1. The joint bearing boss 10*a* is in engagement in areal contact with a guide bearing eye recess 2*f* of the movable jaw element 2, the parts 1 and 2 being coupled to each other in such manner as to allow of a pivotal displacement through the angle $\alpha$. The centre 10*c* of the bearing boss 10*a* is traversed by a securing bolt 10 which projects at the top side through the cover plate, not illustrated in FIG. 3. Due to the jointed connection illustrated in FIG. 3 between the elements 1 and 2, the stress on the free branch of the sheathing plate 7, which is high in the embodiment according to FIGS. 1 and 2, is successfully reduced substantially, and the essential strains of the wrench are transferred into the elements 1 and 2**, respectively.

In a manner analogous to that for the joint boss **10*a*, the fixed jaw element 1 also has integrally formed with it a joint boss 9*a* intended to form the pivot point of the lever, which is in contact in the area of the substantially cylindrical surface 6*f* with a recess 6*t* of the lever 6, which has the form of a circular segment, which terminates tangentially. The areal contact in the region of the joint boss 9*a* and the structure of the lever 6 at the side facing towards the aperture, are so arranged that the pivotability of the lever 6 is authorised for unlocking the locking element system. A securing bolt 9 which is secured in the cover plate, which is not illustrated, in the same way as the bolt 10, also extends through the centre 9*c* of the joint boss 9*a***.

The pivot center **10*c* for the moveable jaw 2 and the pivot center 9*c* for the handle 6 are disposed on a line forming an angle Y of between 15° and 25° with the axis of symmetry of the wrench as shown in FIG. 3**.

The mutually confronted terminal sections **6*e* and 2*e* of the lever 6 or of the movable jaw element 2, in each case bear a hook-shaped extension 6*h* and 2*h*, respectively. In the operating position of the automatic wrench illustrated in FIG. 3, these hook-shaped extensions 6*h* and 2*h* engage in each other with undercut, so that the parts 2 and 6 may complementarily bear tractive and flexural forces, so that stress peaks at other points are reduced by virtue of new stress conditions on the corresponding lever arms. The form of the hook-like engagement of these two components allows of an additional increase of the stability of the automatic wrench, as established by extensive experimentation. The undercut is of such form that the two components may slide past each other upon pivoting the lever 6 from the position illustrated by solid lines into the position illustrated by dash-dotted lines, so that the coupling element 3** is moved out of the extended position.

The assembling operation of the wrench illustrated in FIG. 3 is greatly simplified, since only the components 1, 2 and 6 are joined together with the locking element system and are thereby already immobilised in their reciprocal positions. Finally, a cover plate not illustrated in detail, is installed on the fully assembled parts, to complement the wrench into a finished unit.

The hook-shaped extensions 2h and 6h of the components 2 and 6 assure a convincing complementary overload lock system, so that the tool illustrated in FIG. 3 undergoes considerably less strain, and that the durability is raised considerably, by virtue of the better distribution of the stresses engendered, if high loading moments appear.

The hinged plate 21 which, by pivoting against the internal diameter of the connecting device, forms a surface shown cross-hatched, and which is of extremely advantageous importance during a screwing operation, also represents a feature of the invention. As a matter of fact, this cross-hatched area is equivalent to a supporting or guiding surface on which the tool may be kept in position in slip-proof manner during a screwing operation, and on which it slides, thereby eliminating any positioning with the help of the other hand.

In view of the advantageous replaceability of the screwing tool head as a whole, the new wrench is also advisable for assembling operations in which offset, very short or extended lever extremities are required, in which linkage adjustments have to be undertaken, or in which quite simply long elements, pipes, cables or rod elements inaccessible for ratchet socket drivers are to be screwed together in rational manner, for example as occurring throughout in the fields of sanitation, air-conditioning and refrigeration technology. Considerably simplified assembling operations are however also made available thereby in building machines, ships, engines, transmissions, bodywork and steel-frame multi-storey buildings, special advantages being obtained particuarly in the latter case, in respect of greater safety and mobility, to the effect that under force-locked application of the aforesaid locking joint or locking four-link transmission and by virtue of its novel self-locking gripping action, the ratchet wrench may be left at any time and in any optional position—even in the case of overhead assembling operations—and may always be operated safely with one hand thanks to its integrated and extremely effective auxiliary assembling system.

I claim:

1. A ratchet-like wrench comprising a wrench body provided with a fixed jaw, a two-armed moveable jaw pivoted on the wrench body to define a spanner aperture with said fixed jaw, a two armed wrench handle pivoted on the wrench body and having a pivot bearing which is situated in the extremity of the wrench body facing away from the spanner aperture, one arm of said handle operatively engaging one arm of said moveable jaw, a rocker element, a first pivot joint for pivoting said rocker element on said fixed jaw, a coupling element having second and third pivot joints for pivotally coupling said coupling element to said rocker arm and said one arm of said moveable jaw, respectively, and having a projection operatively coupled to said handle and a return spring disposed between said coupling member and said moveable jaw for biasing said moveable jaw to the open condition and for preloading the coupling element and the rocker element toward a locking position when said handle and said coupling element are in a first position whereby upon movement of said handle to a second position said coupling element will be pivoted to bring said pivot joints into alignment to move said moveable jaw into a locked nut gripping position.

2. A ratchet-like wrench as set forth in claim 1 further comprising jaw insert means adapted to be detachably located in the spanner aperture defined by said fixed and moveable jaws and locking means on said fixed and moveable jaws for securing said insert means in place.

3. A ratchet-like wrench as set forth in claim 1 further comprising an adjusting element moveably supported on said fixed jaw and having means thereon for pivotally supporting said rocker element for pivotal movement relative to said fixed jaw and adjustable screw means carried by said fixed jaw and disposed in engagement with said adjusting element for adjusting the position of the moveable jaw upon movement of the coupling element and the rocker element to said locking position.

4. A ratchet-like wrench according to claim 1 wherein said moveable jaw is provided with a maximum degree of opening mobility of 6° and said handle is pivotable up to a maximum of 15° and wherein the pivot centers for said moveable jaw and said handle are disposed on a line forming an angle of between 15° and 25° with the axis symmetry of said wrench.

5. A ratchet-like wrench as set forth in claim 1 wherein said moveable jaw and said handle are each provided with extensions having complementary hook-shaped portions engageable with each other upon movement of said handle and said moveable jaw into force applying positions.

* * * * *